United States Patent [19]

Mozer

[11] Patent Number: 4,770,009

[45] Date of Patent: Sep. 13, 1988

[54] MECHANISM FOR SELECTING AND CONTROLLING THE RAISING OF NEEDLES IN CIRCULAR AND FLAT BED KNITTING MACHINES, HAVING A PLURALITY OF ADJACENT NEEDLES, WITH ELECTRONIC PROGRAMMING CONTROL

[75] Inventor: Massimo Mozer, Clarens, Switzerland

[73] Assignee: Jumberca, S.A., Barcelona, Spain

[21] Appl. No.: 14,696

[22] Filed: Feb. 13, 1987

[30] Foreign Application Priority Data

Feb. 18, 1986 [CH] Switzerland ..... 631/86

[51] Int. Cl.[4] ..... D04B 9/10

[52] U.S. Cl. ..... 66/218; 66/75.2

[58] Field of Search ..... 66/25, 75.2, 218, 219, 66/221

[56] References Cited

U.S. PATENT DOCUMENTS

| | | | |
|---|---|---|---|
| 1,927,016 | 9/1933 | Adler et al. | 66/218 X |
| 3,340,708 | 9/1967 | Krause | 66/75.2 |
| 3,733,855 | 5/1973 | Bliss-Hill et al. | 66/219 |
| 3,863,465 | 2/1975 | De Cerjat et al. | 66/219 |
| 3,995,451 | 12/1976 | Vinnemann | 66/218 |
| 4,055,058 | 10/1977 | Tewsley et al. | 66/219 |
| 4,167,861 | 9/1979 | Krause et al. | 66/75.2 |

*Primary Examiner*—Ronald Feldbaum

*Attorney, Agent, or Firm*—Staas & Halsey

[57] ABSTRACT

A mechanism selects and controls the raising and lowering of needles in circular and flat bed knitting machines having a plurality of adjacent needles. A rocking pusher is provided for each needle to move each needle back and forth between an outwardly projecting active position and an inward inactive position. Each rocking pusher is engaged with a corresponding cam when the needle is in the engaged position, and is disengaged from the cam in the inactive position. A deflector corresponds to each rocking pusher, and is engageable with a cam profile, which determines the movement of the deflector for its engagement with the rocking pusher. This moves the rocking pusher from the active position to the inactive position. A controllable retaining member engages the deflector to cause the engagement of the deflector with the cam profile. The retaining member is controlled by a control program member, which is controlled by a control program.

18 Claims, 10 Drawing Sheets

FIG. 11
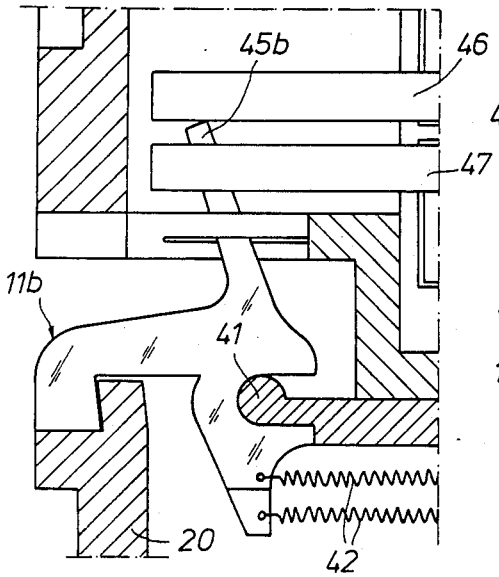
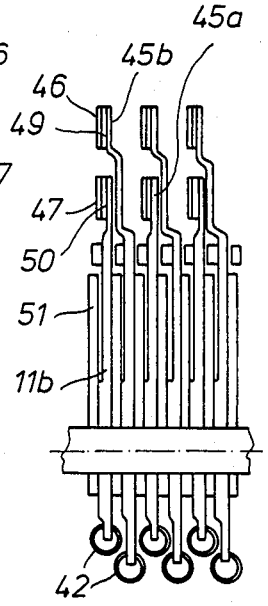
FIG. 9
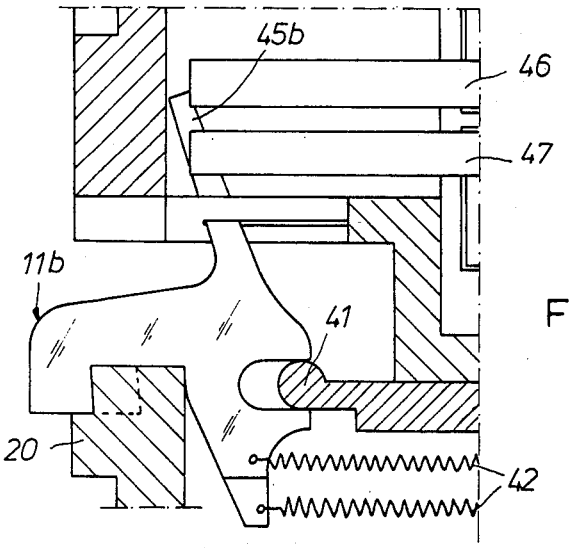
FIG. 12

MECHANISM FOR SELECTING AND CONTROLLING THE RAISING OF NEEDLES IN CIRCULAR AND FLAT BED KNITTING MACHINES, HAVING A PLURALITY OF ADJACENT NEEDLES, WITH ELECTRONIC PROGRAMMING CONTROL

BACKGROUND OF THE INVENTION

1. Field of the Invention

The invention relates to a needle selection mechanism in knitting machines. This mechanism is particularly appropriate for high speed machines having electronic programming and may also be applied with very slim, narrow pitch needles and in high speed machines, as is the case of hosiery machines.

For simplicity, reference is made in the following description to the application to circular machines, this representing no limitation however to the application in flat bed machines, this latter application also being of particular interest.

2. Description of the Related Art

Circular knitting machines have a rotating cylinder provided with axial grooves along which there slide the needles which engage, either with their own butt or through pushers provided with butts, fixed cams (camboxes) which determine the vertical stroke of each needle.

The development of a knitting programme requires that the needles passing over each cambox may be raised and held at preset heights or not raised.

This operation is known as selection and is effected in modern machines with fixed electromagnets which act directly or indirectly on the butts of the needle pushers.

The modern, higher speed machines are provided with rocking pushers, provided in turn with butts for axial raising and a plurality of programmable radial butts which, when pushed by the selection cams, determine the travel of the needle to the desired height.

The selection speed, which may be defined as the number of needles which may be selected per second, is substantially restricted by the angular development of the cam profiles, by the response times of the electromagnets and by the large masses to be accelerated, all the larger the greater the degree of selection which it is wanted to attain.

It is sufficient to say that, to attain total programmability of the needles, there must be pushers provided with as many butts as there are needles, multiplied by the number of levels to be attained. Therefore, in practice, the programming of the needles imposes limits and above all requires the replacement of the pushers for different types of fabric to be knit and, therefore, production downtimes and cost of new components.

SUMMARY OF THE INVENTION

An object of the invention is, therefore, to allow the construction of machines having total needle programming, without having to reprogramme the components for each new fabric to be knit, capable of selecting at a speed which only the other auxiliary functions of the machine may limit, and which are mechanically simple, as may be said of the latest generation of typewriters and calculating machines.

These results are obtained with the present invention which provides a mechanism for selecting and controlling the raising of needles in circular and flat bed knitting machines, having a plurality of adjacent needles, comprising, for each needle, a rocking pusher which may be moved between an outwardly projecting active position, in engagement with a raising cam, and an inward inactive position, disengaged from the cam, in which, in correspondence with each pusher, there is a deflector engageable with a cam profile determining the movement thereof in engagement with the pusher and the movement of the latter from the active position to the inactive position thereof, said deflector being provided with a retaining member which may be activated through a programme control member adapted to cause the engagement of the deflector with the cam profile at any time and in correspondence with any raising height of the needle, depending on what has been programmed in the current programme.

The deflector is provided with a spring member adapted to urge it to engage the corresponding cam profile, there being provided for each deflector a controllable retaining member having a tooth which may engage a portion of the deflector, in antagonism with the spring member, and is disengageable therefrom on receiving a selection command.

The deflector may act on the rocking pusher, moving it from the active position to the inactive position, in any one of several selection points provided by the machine, determining different raising strokes for each needle, depending on the programme being used.

To be more explicit, the deflector may move angularly and radially and is provided with radially and axially operative butt and there is provided for engagement with said butt a cam profile having inwardly extending, radially active protuberances, in correspondence with the contemplated points of selection of the raising heights, which have furthermore an axially operative protuberance, pivoting the deflector towards the position of disengagement from the cam profile and engagement of the deflector with the retaining member tooth, there being provided also outwardly acting spring means urging the deflector, possibly together with a protuberance of the outwardly operating cam profile.

In one embodiment, the deflector is angularly movable to act directly on the rocking pusher and the edge of the rocking pusher is provided with a notch, in an end of stroke position, adapted to restore the hooking of the deflector with the drawing down of the rocking pusher and to push it outwardly by a shaped portion of the channel within which the rocking pusher is housed.

In an alternative embodiment, the rocking pusher is provided with a spring member adapted to urge it radially outwards.

In one particular embodiment, the deflector is formed by a sheet-like member supported to rock about a horizontal axis while being moveable inwardly under the action of a cam profile situated thereabove, and provided with a spring member adapted to urge it upwardly to engage said cam profile, and with a portion engageable with the tooth of the corresponding retaining member.

The spring member associated with the rocking pusher and the spring member associated with the deflector may conveniently be formed by needle-like springs, possibly integral with body of the rocking pusher and of the deflector.

In one particular embodiment of the invention, the rocking pusher is integral with the needle corresponding thereto.

The tooth of the retaining member may be formed by a leaf spring capable of being lifted by an activator, or the tooth of the retaining member may be supported directly by the activator.

The tooth of the retaining member may act in a direction perpendicular to the axis of pivoting of the deflector, or in a direction parallel to the axis of pivoting of the deflector.

Two or more series of spring teeth and activators are arranged on two or more lines, so as to reduce the volume in the circumferencial direction.

The activator is conveniently a sheet-like piezoelectric member, adapted to initiate, when energised, the selection sequence with the release of the retaining member tooth from the engagement thereof with the deflector.

The piezoelectric activators are connected to electronic components rotating with the cylindrical body carrying the machine needles and which may be driven by external commands from a programme control member. The external commands are transmitted to the electronic components connected to the piezoelectric members by air, preferably via optical members acting on corresponding sensors associated with the electronic components controlling the individual deflectors, there being also optical selection means associated with a rotary comblike member, adapted to ensure the synchronisation and phasing of the rotating parts with the programme control member.

Two or more retaining members, with their respective teeth and with the corresponding electronic components are supported by an axially disposed plug-in support which may preferably be radially unplugged, from the corresponding seat on the machine body.

BRIEF DESCRIPTION OF THE DRAWINGS

Further details may be observed in the following description of preferred embodiments of the invention, with reference to the attached drawing figures in which:

FIG. 9 is a front view of the device of FIG. 8;

FIG. 11 shows the device of FIG. 8 with the deflector engaged with the cam in a retracted position;

FIG. 12 shows the device of FIG. 8 with the deflector engaging the cam in an advanced position;

DESCRIPTION OF THE PREFERRED EMBODIMENTS

Figure 1:
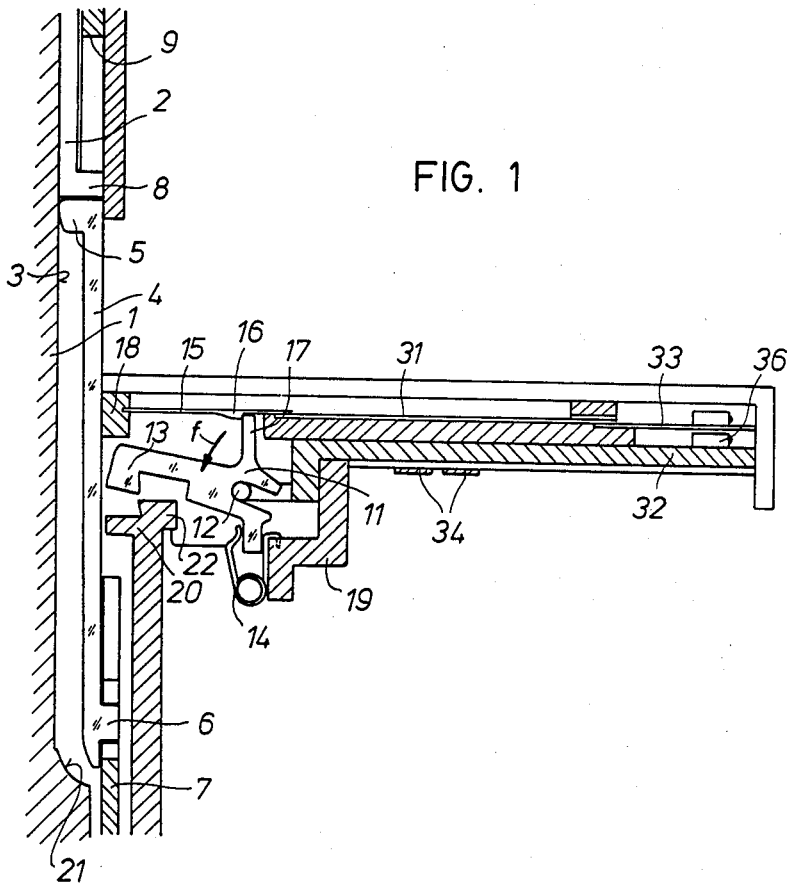
FIG. 1 is a diametral section view of the device of the invention in the rest position.

FIG. 1 shows the cylindrical body 1 of a circular knitting machine in cross section along the line of a needle 2, sliding in a recess or channel 3 of the body 1, within which channel there slides and may pivot radially a rocking pusher 4, having a support protuberance 5 and a butt 6 which may operate with and on a fixed cam profile 7 of a lower or needle raising cambox, unless it is pushed to the bottom of the channel 3.

The profile of a cam 9 of an upper or needle draw down cambox may operate on the butt 8 of the needle 2.

Figure 2:
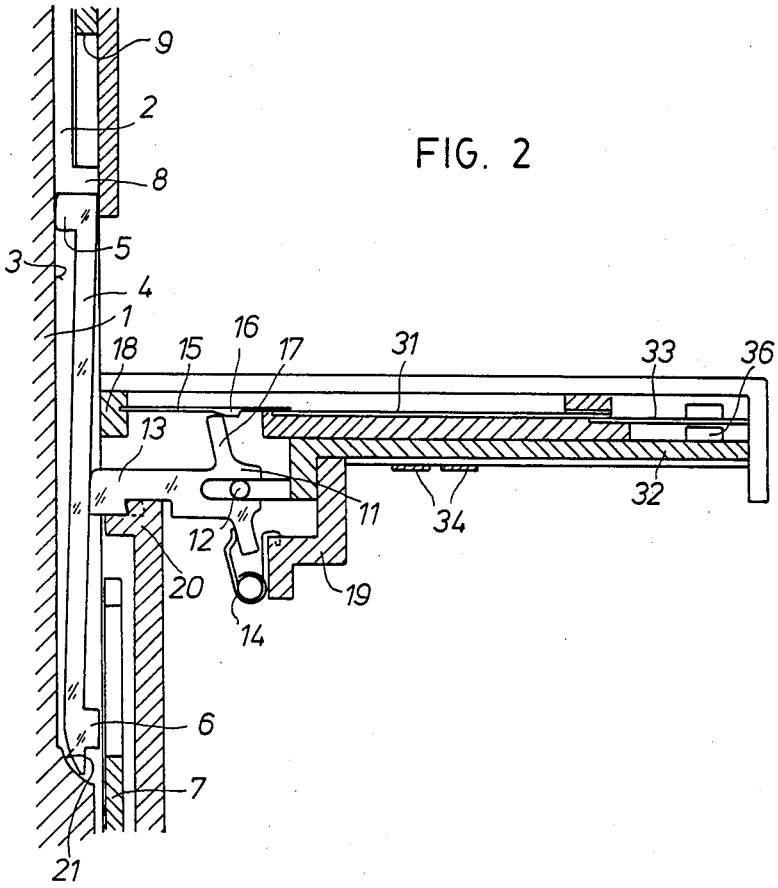
FIG. 2 shows the device of FIG. 1 in the operative position.
Figure 4:
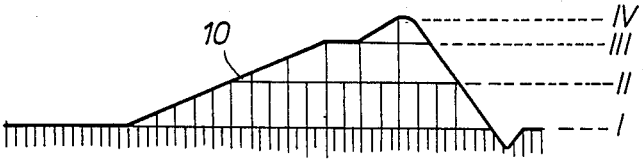
FIG. 4 shows the path followed by the needles in one particular selection.

For greater clarity of the description the mechanism of FIGS. 1 and 2 relates to a limit case of the selection of the of each needle, i.e. with four raising heights contemplated, which may correspond in practice to the stages illustrated in FIG. 4: I—needle down: "float"; II—half raised needle: tuck; III—normal needle: "stitch"; IV—high needle: "transfer or reinforcement".

The different levels are given relative to the profile 10 of the path which may be followed by the needle 2, raised by the rocking pusher 4 when the butt 6 of the latter is held outwardly, to engage with the cam profile 7.

To select the positions to which the needles are to be raised and, therefore, the position of the pushers 4, each of the latter is associated with a selector or deflector 11, angularly and radially engaging a pin 12 of the body 1 by way of a groove. Each deflector 11 is provided with a butt 13 adapted to move the pusher 4 both radially.

The deflector 11 is urged by a spring 14 in the direction of the Arrow f and outwardly, i.e. away from the pusher 4.

The deflector 11 is urged by the spring 14 but is retained in the position of FIG. 1 by a spring member 15, provided with a retaining tooth 16 which engages the appendix 17 of the deflector 11.

The spring member 15 may be formed by a spring inserted at one thereof in a block 18 attached fixedly to the cylindrical body 1 in the same way as the support 19 of the deflector 11 and the spring 14.

For the deflector to be inactive, as shown in FIG. 1, the butt 13 is in the retracted position, the pusher 4 is not moved inwardly and the latter therefore fulfils its mission of raising the needle 2 according to the profile of the lower cambox 7, while the needle is drawn down by the needle butt 8 engaging the profile of the upper cambox 9.

If the free end of the spring member 15 is slightly raised, the deflector 11 is released from the tooth 16 and is thus pivoted by the spring 14 in such a direction that the butt 13 is lowered, as shown in FIG. 2, until it engages the radial selection cam profile 20.

Figure 5:
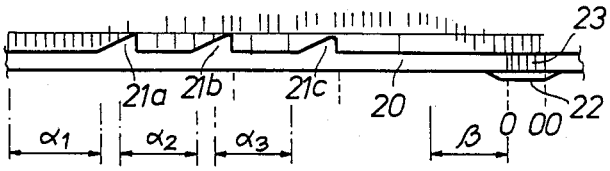
FIG. 5 shows the selection cam profile corresponding to the raising of the needles of FIG. 4.

The profile of cam 20 is provided, as shown in FIG. 5, which is a rectilinear development of the profile, with a plurality of radial protuberances 21*a*, 21*b*, 21*c* and a raising profile 22, adapted to engage the butt 13 of the deflectors 11.

The deflector 11 is released from the engagement thereof with the retaining tooth 16 in advance of the needle raising area, along the arc $\alpha_1$ of the selector cam 20, shown in rectilinear development in FIG. 5.

By way of the end 13, acting as selector butt, the deflector 11 contacts the cam 20 and is pushed radially to move the rocking pusher 4 to the bottom of the channel 3, as shown in FIG. 2, deactivating it before the uplift starts. If the deflector 11 is released in successive angular positions, comprised in the arcs $\alpha_2$ and $\alpha_3$ of FIG. 5, it deactivates the rocking pusher 4 in any one of the needle heights, in predetermined positions of the construction of cam profile 20, thereby interrupting the raising of the needle at the different desired levels II, III, IV.

Along arc $\beta$, in the draw down stage, the needle 2 pushes the pusher 4 downwardly which, under centrifugal force and the shaped entrance 21 of the lower end of channel 3, reassumes the initial position; in turn, along this arc $\beta$ of disengagement from the cam profile 20, the deflector is moved outwardly, either urged by the spring 14 or forced by the pusher 4 or by the action of an external protuberance 22 of the cam profile 20, until complete return, which coincides with point O of FIG. 5. Immediately thereafter the cam profile 20, in the region of point OO, adds an axial function to its radial selection function, causing with the ramp 23 thereof the raising of the butt 13 of the deflector 11 until the appendix 17 is returned to the position of being hooked behind the tooth 16 of the spring member 15.

The maximum speed at which selection may be performed depends on the time and space available for the deflector 11 to engage the cam profile 20. Although the system's response times are already short to allow for speeds much higher than those currently used, they may, however, be made compatible with any selection speeds, it being possible to have recourse to the same advance system according to criteria such as those used particularly in internal combustion engine systems.

Figure 6:
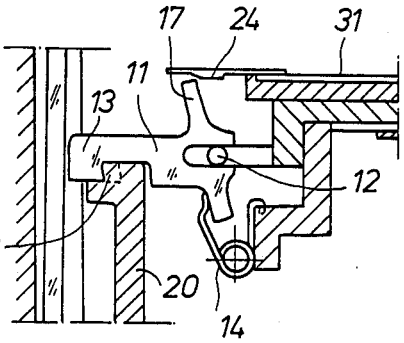
FIG. 6 shows an alternative embodiment of the device of the invention.

In the embodiment of FIG. 6, the only modification is that a retaining tooth 24 for the deflector 11 may be supported directly by a raising member said raising member is described better below.

Figure 7:
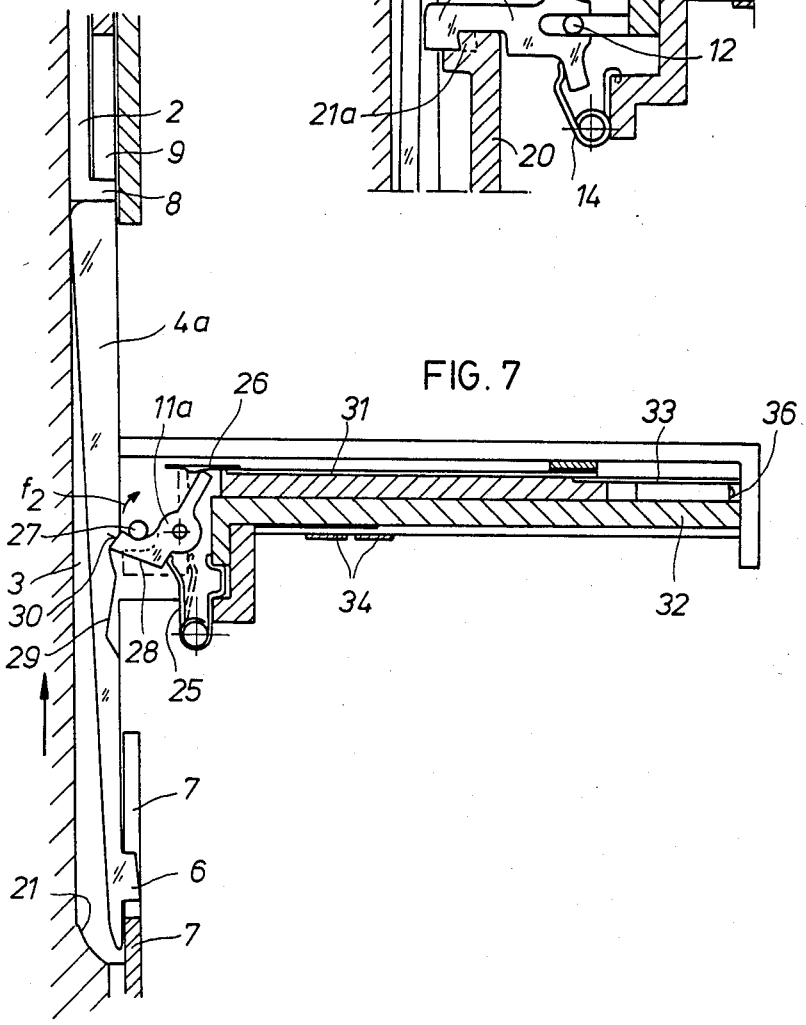
FIG. 7 shows yet a further embodiment.

The embodiment illustrated in FIG. 7 is provided with a device very similar to that of FIGS. 1 and 2, with the variation of FIG. 6, from which it differs in the absence of the selector cam profile 20, the functions of which are developed by the deflector 11*a* itself, which is urged by a spring 25 acting in the direction of the arrow $f_2$ on the deflector 11*a*, the retaining tooth 26 acting in the opposite direction to that of tooth 24 in FIG. 6.

A stop member 27 defines the released position of the deflector 11*a*.

The shoulder 28 of the deflector 11*a* is adapted to engage the rocking pusher 4*a*; notches 29 in the outer edge of the rocking pusher 4*a* are provided to engage the shoulder 28. After the deflector 11*a* is released from the tooth 26, the rocking pusher is disengaged from the cam profile 7 in one of the two selection positions shown in FIG. 5.

The return of the deflector 11*a* to its position occurs at the end of the knitting cycle by effect of the restoring tooth 30 with which the rocking pusher 4*a* is provided and which engages the shoulder 28 of the deflector 11*a*.

To activate a deflector 11 or 11*a*, i.e. to release it from the spring retaining tooth 16, 24 or 26, there is provided a piezoelectric activator 31, adapted to raise the retaining tooth to release the deflector.

Leaf spring members may advantageously used which, when electrically energized, flex and may thus perform an indirect or direct mechanical action, as shown respectively in FIGS. 1, 2 and 6 and 7. In FIGS. 1 and 2 the leaf springs 31 are illustrated as attached to a disc 32 which rotates with the cylindrical body 1 and with the support 19, on which there is supported a printed circuit 33 supplied through slip rings 34 wiped by fixed brushes (not illustrated).

Figure 3:
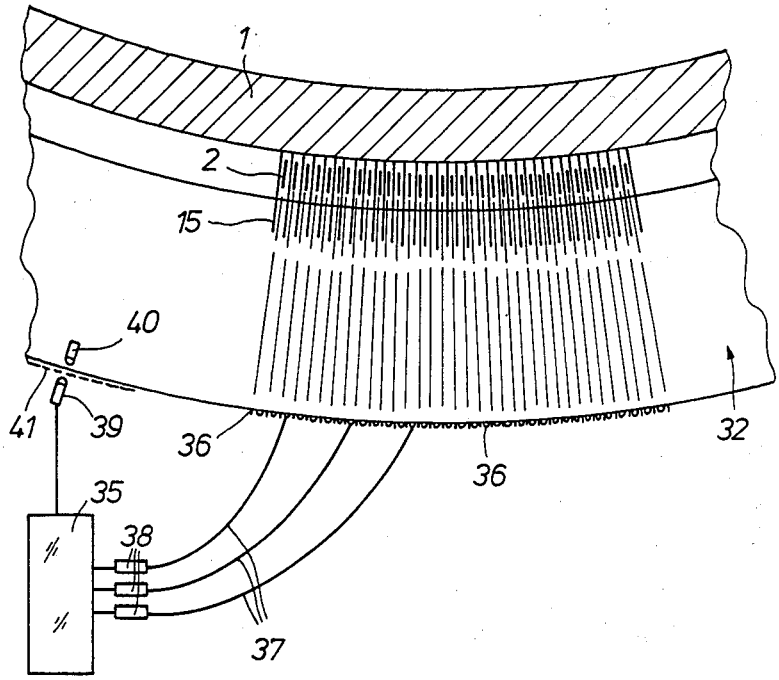
FIG. 3 is a schematic plan view of the device of FIG. 1.

The printed circuit 33 is provided with electronic components adapted to transmit the pulses received from a programmer 35, shown in FIG. 3, to each activating piezoelectric member, formed by the leaf spring 31.

The transmission from the programmer to each of the circuits 33 associated with each needle may be effected advantageously in the illustrated embodiment, relating to circular machines, by light paths.

In this case, a receiving photodiode 36 is associated with each needle, disposed on the periphery of the disc 32, and adapted to receive the signals emitted by the programmer, either directly or through optical fibres 37, through a respective LED 38, of a number equal to the number of desired selections.

Each light emitting station, such as the end of each optical fibre 37, is arranged in one of the already identified angular positions, coinciding with the desired deflector release positions, as exemplified in FIG. 5.

The programmer 35 is synchronised with the cylindrical body 1 through a position detector which enables the emission of the commands needle by needle, and is formed, for example, by two diodes, one of which is an emitter 39 and the other a receiver 40, both being fixed, and a comb-like screen 41 which rotates with the cylindrical body, to provide the signals to the programmer on the rotation of the body 1.

According to FIGS. 8-12, relating to an embodiment of the invention particularly adequate for use in machines equipped with very slim needles, there are provided deflectors 11*b* which may pivot and slide relative to sliding pivoting profiles 41*a*, similar to those marked with the reference numeral 12 in the previous embodiments.

Helical springs 42, arranged at two levels for reasons of volume, are also provided to react with the lower appendix 43 of the deflector 11*b* and the fixed anchor points 44.

The deflectors 11*b* are each provided with an upper appendix 45*a* or 45*b* extending upwardly to different heights, the longer ones being bent, as better seen in FIG. 9. The appendices 45*a* and 45*b* alternate.

The appendices 45*a*, 45*b* are each flanked by leaf springs respectively referenced 46, 47, arranged on two different levels. Each leaf spring engages a piezoelectric member 48, shown in FIG. 10 and adapted to deflect it orthogonally to the development of the appendices 45*a*, 45*b*. Each leaf spring 46, 47 is provided with a tooth, bearing the reference numeral 49, 50 in FIGS. 9, 10, adapted to engage the respective appendix 46 or 47 and to release it when the piezoelectric member 48 is energised and the leaf spring 46 or 47 is deflected from the axis of retention of the respective appendix 45*a* or 45*b*.

Figures 8, 10:
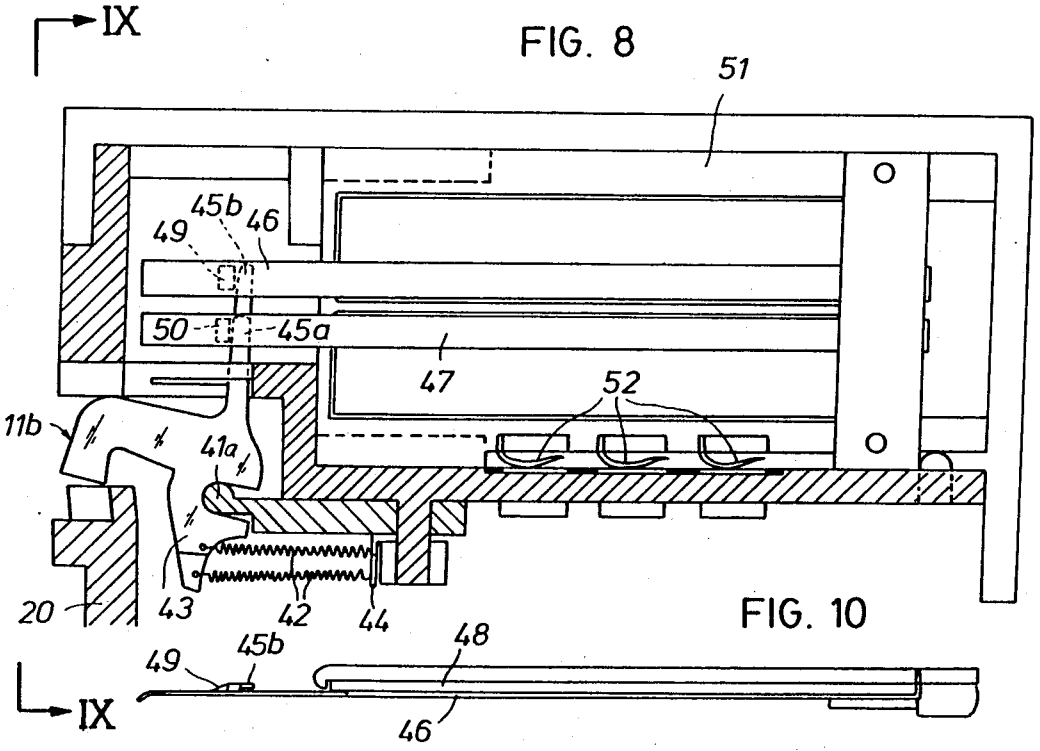
FIG. 8 is a side view of yet another embodiment of the device.
FIG. 10 is a plan view of the device of FIG. 8.

The operation shown in FIGS. 8, 11, 12 is, therefore, similar to that of the previous embodiments, except that the leaf springs, instead of being all coplanar and arranged in a plane perpendicular to the axis of the cylindrical body 1 carrying the needles, are arranged in radial planes orthogonally divergent from that of the previous embodiments, to act laterally on the retaining appendices 45*a*, 45*b* of the adjacent deflectors 11*b* and furthermore for the fact that both the piezoelectric members 48 and the respective leaf springs 46, 47 bearing the retaining teeth 49, 50 and the springs, like those referenced as 42, are arranged in at least two arrays around two planes perpendicular to the axis of the cylindrical body 1 carrying the needles, for reasons of volume, i.e. to maintain the individual deflectors 11*b* close together, with a limited spacing therebetween, to allow for a limited needle pitch in the body 1.

The cam profile 20 may drive the deflectors 11*b* either inwardly, with the radially extending internal profile, or outwardly, with the also radially extending external profile, or raise them, with the axially extending profile, like in the previous case.

The leaf springs 46, 47 of two adjacent deflectors 11*b* may be supported by plug-in frames 51, arranged on geometrical planes crossing the axis of the needle cylinder, and capable of being plugged in radially in slot seats of the structure surrounding the ring of deflectors 11*b*. The plug-in frames are provided with the electronic components belonging to the respective piezoelectric activators and sliding contacts 52 are provided. Thus ease of removal for repair and other operations is facilitated. The deflectors 11, 11*a*, 11*b* are in turn easily replaceable, being housed in outwardly opening slots.

Figures 13, 17:
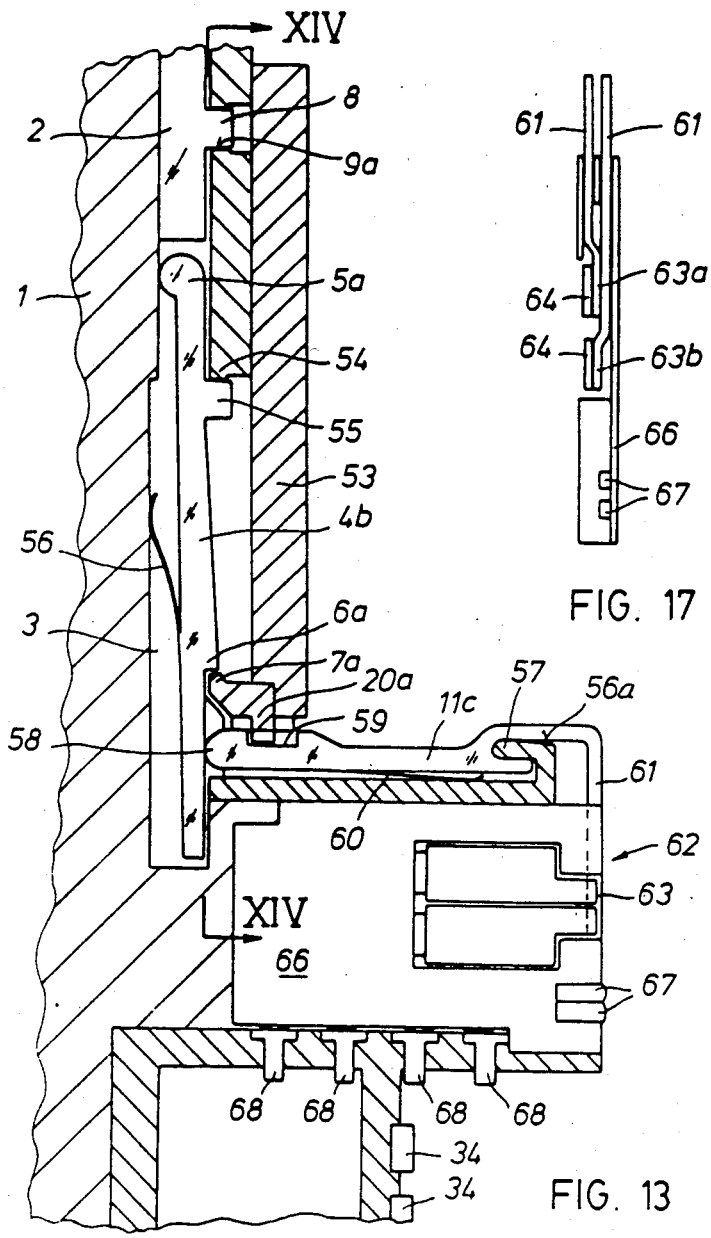
FIG. 13 is a cross section view of a further embodiment of a device according to the invention.
FIG. 17 is a front view of the control unit of FIG. 16 on the line XVII.

As shown in FIG. 13, in a further embodiment of the invention, there is a circular plate 53, surrounding they cylindrical body 1, on the inner surface of which the cam profiles 7*a* are formed for raising the rocking pushers 4*b*, the profiles 9*a* for drawing the needles 2 up and down and the profiles 54 for drawing the rocking pushers 4*b* down.

Figure 14:
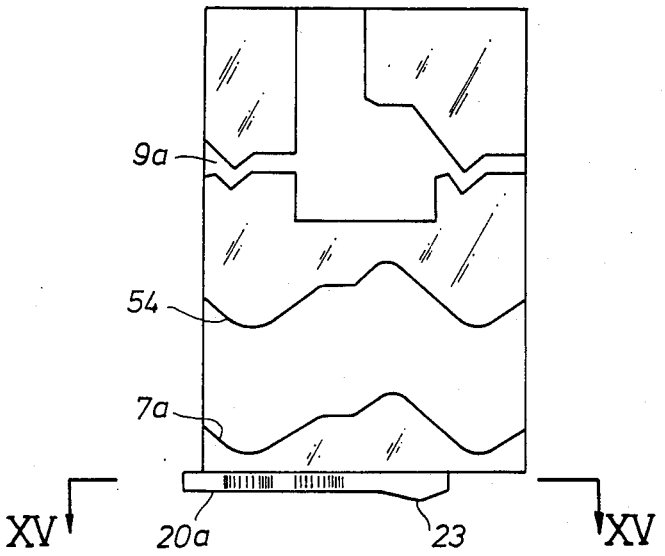
FIG. 14 is a cross sectional view on the line XIV—XIV of FIG. 13.

Said cam profiles are shown on plane development in FIG. 14.

Figure 15:
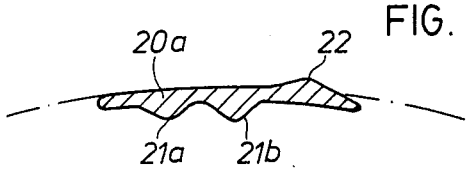
FIG. 15 is a cross sectional view on the line XV—XV of FIG. 13.

The lower edge of the plate 53 is also provided with the radial cam profile 20*a*, which engages the deflector 11*c*, and is shown in section in FIG. 15.

The rocking pusher 4*b* is provided with a raising butt 6*a*, which may engage the cam profile 7*a*, an upper end 5*a* adapted to engage the lower end of the needle 2 to raise the latter and to form the bearing point for the pivoting of the rocking pusher itself, and a butt 55 engaging the cam profile 54 for drawing down the rocking pusher.

The rocking pusher 4*b* is provided also with a spring member 56, advantageously needle-like, adapted to engage the bottom of the channel 3a in which the rocking pusher is housed, to urge the rocking pusher radially outwards, in antagonism with the action of the deflector 11*c*.

The presence of said spring member is desirable in cases in which the centrifugal force of the rotation and the curved profile 21 of the lower end of channel 3 are not sufficient to allow a speedy return of the rocking pusher in engagement with the raising cam profile 7*a*. The deflector 11*c* is constituted by a shaped, radially extending sheet-like member and pivotably supported and inwardly moveable by way of a slot 56*a* and a pivot member 57 attached to the body 1. The end 58 of the deflector forms the butt engaging the rocking pusher 4*b* and in the proximity thereof, on the upper edge of the deflector, there is provided a notch 59 adapted to engage the radial cam profile 20*a*. At the lower end thereof the deflector is provided with a spring member 60, conveniently formed by a needle-like spring, adapted to pivot the deflector 11c around the pivot member 57 raising the end 58 of the deflector and placing the notch 59 in engagement with the radial cam profile 20*a*. The outwardly directed action of the spring member 56 of the rocking pusher, engaged by the deflector 11*c*, guarantees correct engagement of the deflector with the cam profile 20*a*.

The deflector 11*c* also extends to the outside of the machine, beyond the pivot member 57, with an arm 61, adapted to engage one of the control members 62.

Figure 16:
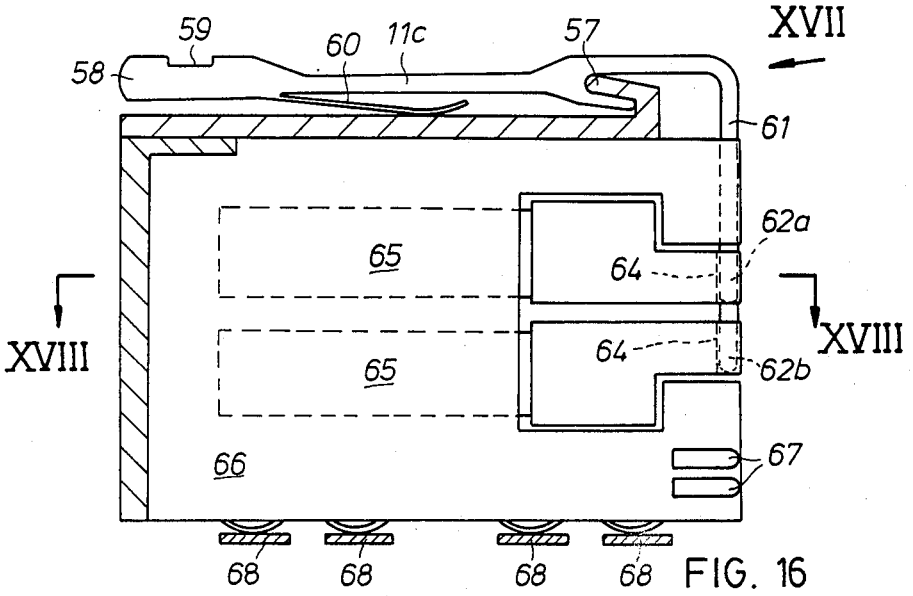
FIG. 16 is a detail of the control unit of the device of FIG. 13.
Figure 18:
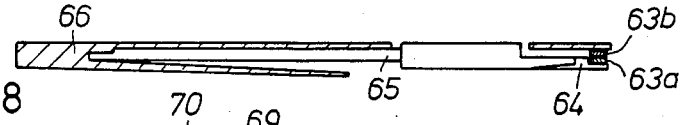
FIG. 18 is a cross sectional view on the line XVIII—XVIII of FIG. 16, showing the piezoelectric member in the deenergised position.

As shown in FIGS. 16, 17, 18, the arm 61 of the deflector 11*c* is provided with an end 63 engaging the retaining tooth 64 of a sheet-like piezoelectric member 65 and is locked thereby, preventing the inward rotation thereof.

Conveniently, to reduce the volumes in a circumferential direction, the deflectors 11c are arranged side by side in pairs and are provided, in each pair, with arms 61 of different length, adapted to engage the respective lower ends 63*a*, 63*b* and the retaining teeth of two sheet-like piezoelectric members superimposed one above the other and disposed in the same plane, housed in a single support 66.

Figure 19:
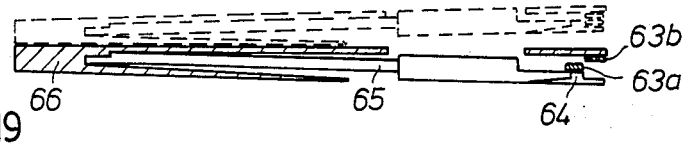
FIG. 19 shows the piezoelectric of FIG. 18 in the energised state.

As shown in FIG. 19, when one of the sheet-like members 65 is energised electrically, it flexes sideways and releases the arm 61 from its retaining tooth 64, thereby allowing pivoting of the deflector 11c under the effect of the spring member 60 and the engagement thereof with the cam profile 20*a*.

The energising of the sheet-like piezoelectric members 65 is controllable by the machine programmer through photoelectric cells 67 which control an electronic circuit housed on the support 66 and supplied through contacts 68, connected in turn to the slip rings 34.

The configuration of the control elements 62 in plug-in supports bearing the piezoelectric members relating to one pair of adjacent deflectors and the corresponding drive circuit, which may be plugged in and removed from the outside of the machine, allows for speedy assembly and easy maintainance operations, without a fault in one of them requiring other adjacent members to be touched for the repair thereof.

Furthermore, in the embodiment of FIG. 13 and following, there is the possibility of preparing all the cam profiles, for raising the rocking pusher, for drawing the latter down, for drawing the needle down and for the radial movement of the deflector on a single elaborate member, thereby simplifying the construction of the machine and facilitating subsequent replacement or adjusting operations.

Figure 20:
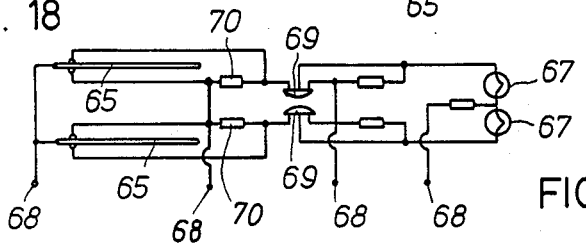
FIG. 20 is a wiring diagram of the piezoelectric member energising circuit.

The electric control circuit for driving the sheet-like piezoelectric members 65 is shown in FIG. 20. Here there are shown in photoelectric cells 67 which drive respective SCR transistors 69 through which the sheet-like piezoelectric members 65 are supplied. The circuit may be made, as illustrated, with separate components, or in integrated form, and allows for the controlled supply of power to the pair of sheet-like piezoelectric members 65 supported by the plug-in support on which the circuit is mounted.

A modification of the values of the resistors 70 of the circuit also allows the circuit response times to be adjusted in the light of requirements, by varying the discharge times of the sheetlike piezoelectric members, which act as capacitors.

Figure 21:
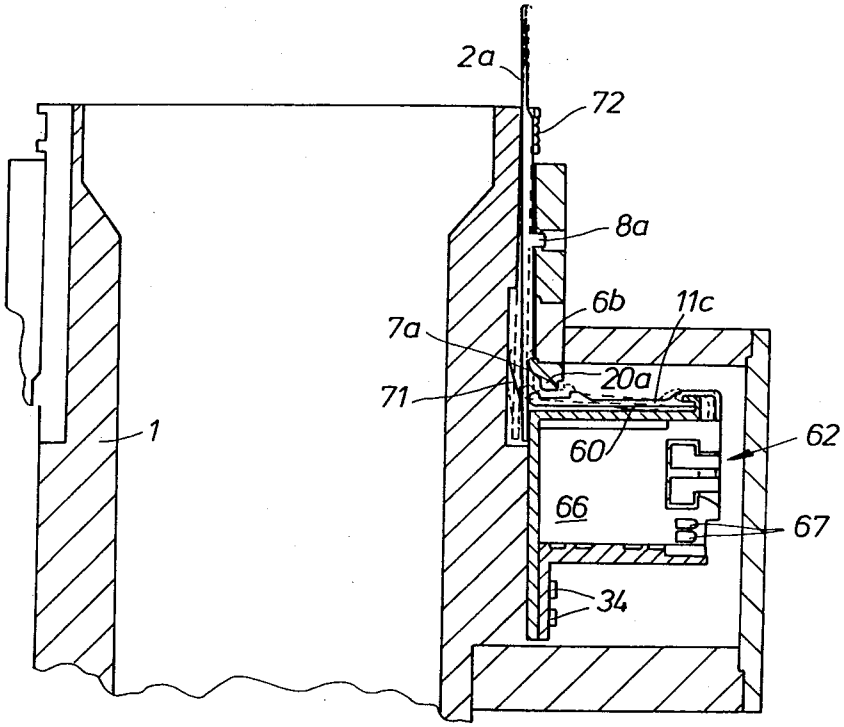
FIG. 21 shows yet a further embodiment of the device of the invention.

FIG. 21 finally shows another possible constructional variation in which the needle 2 and the rocking pusher 4*b* are united in a single needle member 2*a*, provided with a tooth 6*b*, adapted to follow the cam profile 7*a* and a drawdown control butt 8*a*. The needle member 2*a*, provided with a needle-like spring 71, pivots about its attached upper radial position 72 which is fairly close to the end of the needle which therefore describes, in said pivoting, a fairly small radial movement, having no effect on the machine operation. Under such conditions, a notable constructive simplification of the machine, with considerable advantages, may be had Many variations may be introduced without exceeding the scope of the invention.

What I claim is:

1. A mechanism for selecting and controlling the raising of needles in circular and flat bed knitting machines having a plurality of adjacent needles, comprising:

a rocking pusher member for each needle movable between an outwardly extending active position, in engagement with a raising profile, and an inward inactive position, disengaged from the raising profile;

a deflector for each said pusher and engageable therewith;

a cam profile for each said deflector and engageable therewith, having a plurality of radial protuberances having predetermined arcs, each said profile determining the movement of each corresponding said deflector into engagement with its corresponding said pusher and the movement of said pusher from the active position to the inactive position;

a controllable retaining member provided for each said deflector for engaging its corresponding said deflector with its corresponding said cam profile;

a program control member, corresponding to and for activating each said retaining member to cause the engagement of its corresponding said deflector with its corresponding said cam profile in any of said radial protuberances in response to a control program.

2. The mechanism of claim 1, wherein each said deflector is provided with a spring member adapted to urge said deflector to the position of engagement with the corresponding cam profile, there being provided for each said deflector said controllable retaining member having a retaining tooth for engaging a portion of the deflector in antagonism with the action of the spring member, disengageable therefrom on receipt of a selection command.

3. The mechanism of claim 1, wherein each said deflector may act on its corresponding said rocking pusher, moving it from the active position to the inactive position, in any one of several selection points provided by the mechanism, determining different raising strokes for each needle according to the control program in use.

4. The mechanism of claim 2, wherein each said deflector is angularly and radially movable and is provided with a radially and axially operative butt and wherein for engagement with said butt there is provided the cam profile having inwardly directed, radially operative protuberances in correspondence with the contemplated points of selection of the raising heights, having furthermore an axially operative protuberance pivoting the deflector towards the position of disengagement from the cam profile and engagement with the tooth of the retaining member.

5. The mechanism of claim 1, wherein each said rocking pusher is provided with spring means adapted to urge said rocking pusher radially outwards.

6. The mechanism of claim 5, wherein each said deflector comprises a sheet-like member rockingly supported with the axis thereof on a horizontal plane and inwardly movable under the action of a cam profile situated thereabove, and is provided with spring means adapted to urge said deflector upwardly into engagement with said cam profile and a portion capable of engagement with the tooth of the corresponding retaining member.

7. The mechanism of claim 6, wherein the spring means provided for each said rocking pusher and the spring means provided for each said deflector comprise needle-shaped springs.

8. The mechanism of claim 6, wherein the rocking pusher is an integral portion of the needle corresponding thereto.

9. The mechanism of claim 2, wherein the retaining tooth of each said retaining member is controllable by a leaf spring movable by an activator for raising and lowering the retaining tooth with respect to its corresponding said deflector.

10. The mechanism of claim 2, wherein the retaining tooth of each said retaining member is directly supported by an activator, which raises and lowers the retaining tooth with respect to its corresponding said deflector.

11. The mechanism of claim 2, wherein the retaining tooth of each said retaining member acts upon its corresponding said deflector perpendicularly to pivoting axis of its corresponding said deflector.

12. The mechanism of claim 2, wherein the retaining tooth of each said retaining member acts upon its corresponding said detector parallel to the pivoting axis of its corresponding said deflector.

13. The mechanism of claim 9, wherein the activator is a sheet-like piezoelectric member adapted to initiate, when energized, the selection sequence with the release of the tooth of the retaining member from the engagement thereof with the deflector.

14. The mechanism of claim 13, wherein the piezoelectric activators are connected to electronic components rotating with the cylindrical body carrying the machine needles, and which may be driven by external commands from a programme control member.

15. The mechanism of claim 14, wherein the external commands are transmitted to the electronic components connected to the piezoelectric members by air, through optical members acting on the corresponding sensors associated with the electronic control components of the individual deflectors, there being also provided optical selection means associated with a rotating comb-like member and adapted to ensure the synchronization and phasing of the rotating parts with the programme control member.

16. The mechanism of claim 14, wherein two or more retaining members, with their respective teeth and with the corresponding electronic components, are supported on a plug-in type support disposed in an axial plane and capable of being independently, preferably radially, unplugged from the corresponding seat in the machine body.

17. The mechanism of claim 7, wherein the spring means means provided for each said rocking pusher and the spring means provided for each said deflector are integral with each said rocking pusher and each said deflector, respectively.

18. The mechanism of claim 10, wherein the activator is a sheet-like piezoelectric member adapted to initiate, when energized, the selection sequence with the release of the tooth of the retaining member from the engagement thereof with the deflector.

* * * * *